United States Patent [19]

White, Jr.

[11] Patent Number: 4,592,173

[45] Date of Patent: Jun. 3, 1986

[54] HONE FOR GEROTOR STATORS, AND HONING METHOD

[76] Inventor: Hollis N. White, Jr., 243 Pyle Ln., Hopkinsville, Ky. 42240

[21] Appl. No.: 626,446

[22] Filed: Jun. 29, 1984

Related U.S. Application Data

[63] Continuation-in-part of Ser. No. 320,465, Nov. 12, 1981, abandoned.

[51] Int. Cl.[4] ..... B23F 19/05

[52] U.S. Cl. ..... 51/330; 51/1; 51/34 K; 51/355

[58] Field of Search ..... 51/1, 34 R, 34 H, 34 J, 51/34 K, 330, 355

[56] References Cited

U.S. PATENT DOCUMENTS 1,662,137 3/1928 Summers ..... 51/34 K 2,390,916 12/1945 Bothner ..... 51/1

*Primary Examiner*—Frederick R. Schmidt

*Assistant Examiner*—Joseph T. Zatarga

*Attorney, Agent, or Firm*—Woodling, Krost & Rust

[57] ABSTRACT

An apparatus and method for honing cylindrical bores adjacent to a larger cavity or bore is disclosed. The apparatus comprises a set of expandable abrasive-coated frustro-conical sleeves mounted on rotating shafts, one for each cylindrical bore, which circumferentially surround, and are supported by, a rotating inner supporting member. The sleeves and supporting member are moved through the bore and larger cavity in a direction along their axis of rotation, and in so doing, the sleeves contact the bore walls to impart a honing action. A means for precisely adjusting the final honing diameter of the sleeves is provided, as well as means for adjusting the distance of the sleeves from the center of the larger cavity. By adjusting the sleeves at successively closer positions to a desired final bore, the bore can be honed with great accuracy.

15 Claims, 12 Drawing Figures

FIG. 1
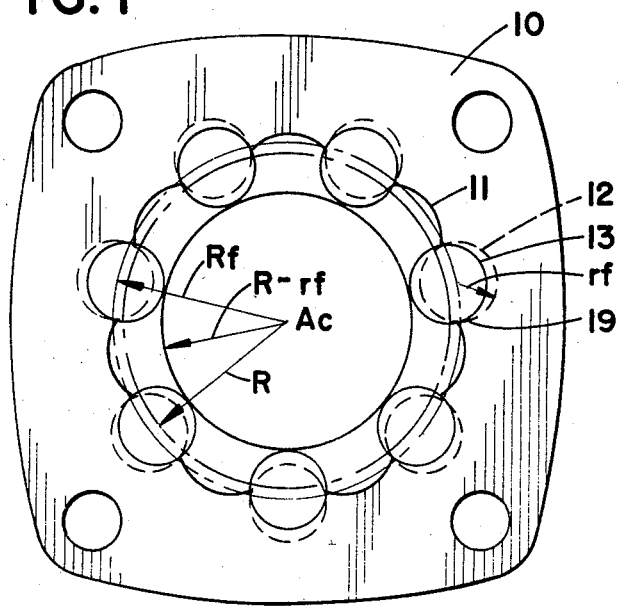
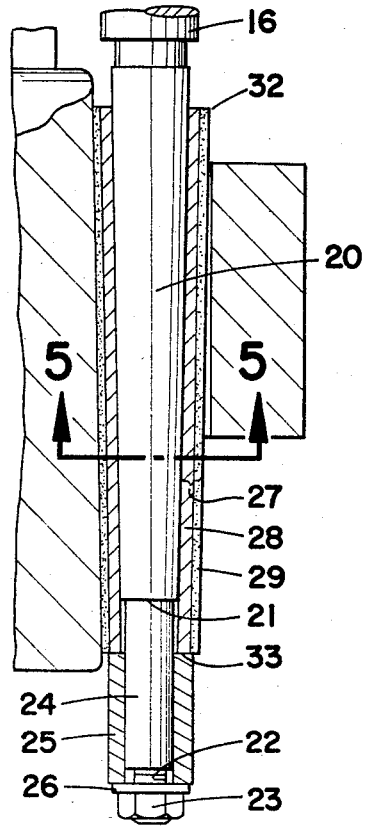
FIG. 4
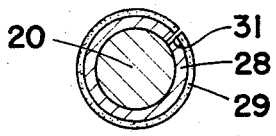
FIG. 5
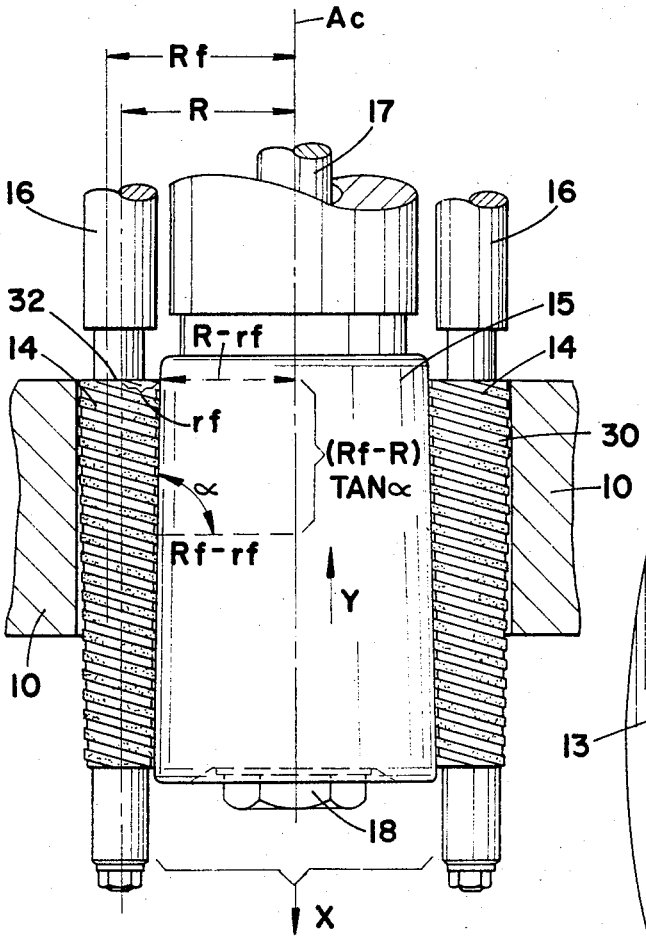
FIG. 3
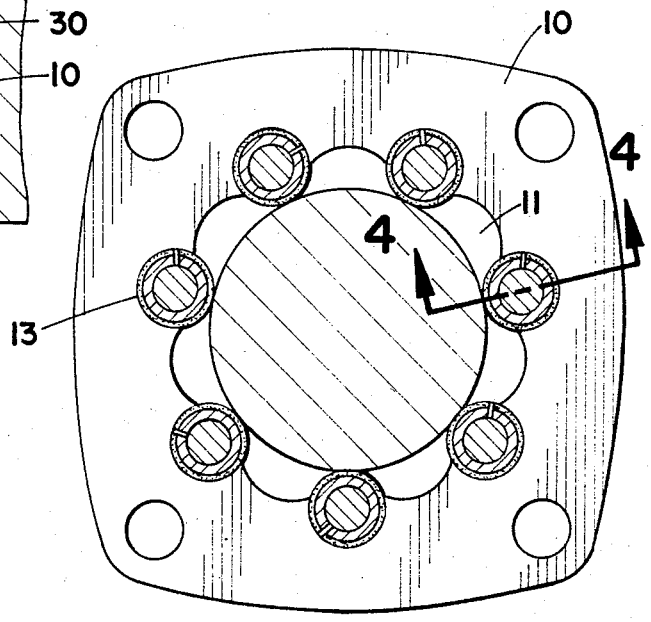
FIG. 2

HONE FOR GEROTOR STATORS, AND HONING METHOD

This application is a continuation-in-part application of U.S. patent application Ser. No. 320,465, filed Nov. 12, 1981 entitled "Hone for Gerotor Stators, and Honing Method", now abandoned.

This invention relates to the abrasion of cylindrical bore or portions thereof, and in particular to a hone for the roller pockets of a gerotor stator.

One type of gerotor has as its stator teeth cylindrical rollers which fit into pockets in the stator. It is usual to form these pockets by broaching. A great degree of precision is needed in the ultimate inside diameter of the pockets, and the broaching process along is not entirely satisfactory in achieving this precision.

My invention is an apparatus and method which may be used after broaching to hone the pockets to any desired inside diameter. Essentially it comprises a set of expandable abrasive-coated frustro-conical sleeves mounted on rotating shafts, one for each roller pocket, which circumferentially surround, and are supported by, a rotating inner supporting member. The sleeves and supporting member are pushed through the rotor cavity in a direction along their axis of rotation, and in so doing, the sleeve contact the roller pockets to impart a honing action. A means for precisely adjusting the final honing diameter of the sleeves is provided, as well as means for adjusting the distance of the sleeves from the axis of the stator.

It is an object of my invention to provide a stator hone for the roller pockets of gerotor stators, which can easily be adjusted to hone the pockets to within a close tolerance of any needed diameter.

Another object of my invention is to provide such a stator hone which can be used for repeated passes through the stator.

A further object of my invention is to provide a method for honing a cylindrical bore, or portion thereof, with great accuracy, where the desired bore or portion thereof is at the perimeter of a preexisting cavity of the workpiece.

These and other objects will be seen by referring to the following description and claims, taken in conjunction with the accompanying drawings, in which:

FIG. 1 shows a diagrammatic view of a gerotor stator with the honing apparatus of my invention in place;

FIG. 2 shows the same but in cross-section;

FIG. 3 shows an elevational view of the same hone apparatus, and a partial cross section of the stator;

FIG. 4 is a partial sectional view of my apparatus, taken along the line 4—4 of FIG. 2;

FIG. 5 shows a section of a typical conical sleeve and supporting shaft of my hone, taken along the line 5—5 of FIG. 4;

Figure 6:
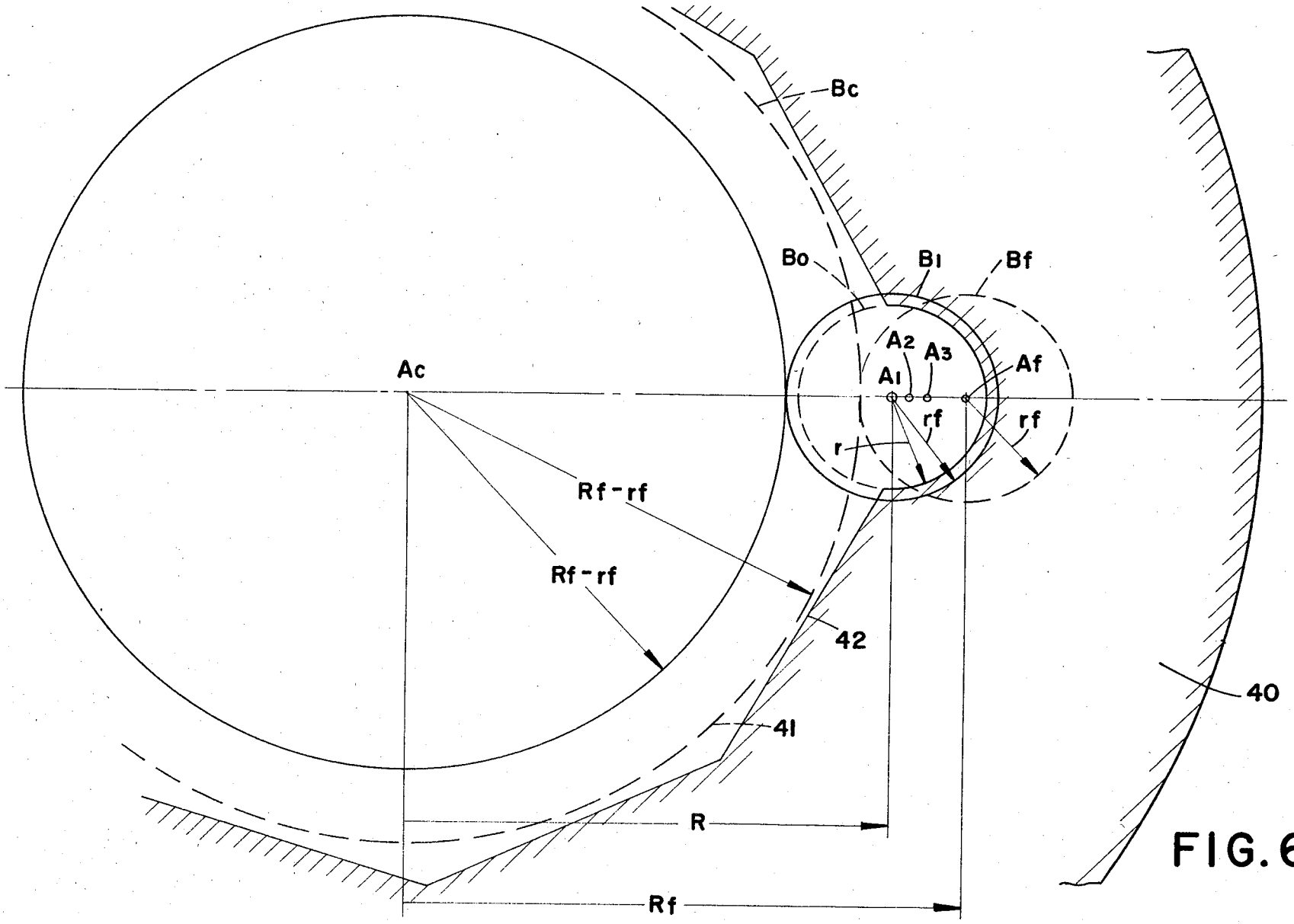
FIG. 6 is a diagrammatic representation of the general honing method of my invention.

FIG. 1 shows the stator 10 of a gerotor. The stator 10 is provided with a rotor cavity 11 consisting generally of a central, large lobed cylindrical bore having a center axis $A_c$ and having at its periphery a number (in this case, seven) of smaller semi-cylindrical bores which serve as pockets for cylindrical rollers. The pockets in their final configuration will have the surfaces shown in section as the dashed small semi-circles 12.

A preferred embodiment of the honing apparatus of my invention is best seen by considering also FIG. 3.

Seven similar individual tapered abrasive hones 14 are disposed around, and supported by, a hone-supporting member 15. Both the hones 14 and supporting member 15 have outer frustro-conical surfaces. The hone-supporting member 15 has a taper matching that of the hones 14 so that the axes of all frustro-conical surfaces are parallel.

The hones 14 and the hone-supporting member 15 are carried on the distal ends of shafts 16 and 17, which are caused to rotate by any conventional means located at their proximal ends. The shafts 16 are also supported at their proximal ends by any conventional means which will permit the proximal ends to be moved radially farther away from $A_c$. In my own practice of the invention, the small amount of necessary movement is provided by tolerance in the joints. The rotational speeds of the shafts are adjusted so that the circumferentical volocities of the frustro-conical surfaces are equal at any point along their axes; there will thus be little or no friction between the hone-supporting member 15 and the hones 14.

The hone-supporting member 15 is slidingly mounted upon its shaft 17 by any conventional means so that when a nut 18 is loosened, the hone-supporting member 15 may be adjustably repositioned on its shaft 17. An upward axial adjustment will shift the hone-supporting member 15 upward with respect to the hones, and since the hone-supporting member 15 has the larger end below, the hones will be supported at a greater distance from the axis $A_c$ of the hone-supporting member 15 and its shaft 17. The hone-supporting member 15 is preferably carbide-surfaced so that the hones do not abrade longitudinal grooves in the surface during the adjustment process.

FIGS. 4 and 5 show the inner construction of the individual hones. The shaft 16 of each hone carries thereupon a frustro-conically shaped member 20 coaxial with the shaft 16 and with its smaller end 21 closest to the end of the shaft. The member 20 can be either an integral section of the shaft 16 or a separate member removably affixed to it. The end of the shaft 16 is provided with threads 22 and a nut 23 is threaded thereupon. Adjacent to the threaded portion of the shaft, and lying between that portion and the frusto-conically shaped member, is a cylindrical portion 24 of the shaft, which portion is surrounded by a cylindrical sleeve 25 slidingly mounted upon it. This sleeve 25 is separated from the nut 23 by a flat washer 26. When the nut is advanced towards the body of the shaft, the cylindrical sleeve is forced in the same direction.

Surrounding the frustro-conically shaped member 20, and fitting it closely but slidingly, is an abrasive sleeve 27 of uniform thickness. It consists of a frustro-conical sleeve 28 faced on the outside with an abrasive material 29; I prefer copper-embedded diamond surfacing, but other suitable materials will be well known to those skilled in the art. I also prefer to provide the outer surface of the frustro-conical sleeve with shallow helical grooves 30 (FIG. 3) to serve as passageways for oil. I use a high-sulfur paraffin base oil in the honing.

A longitudinal slot 31 passes through the sleeve for its entire length, as seen in section in FIG. 5. The slot 31 permits a small amount of radial expansion of the abrasive sleeve 27. The smaller end 33 of the abrasive sleeve 27 abuts the cylindrical sleeve 25 so that when the nut is tightened, forcing the cylindrical sleeve up the shaft 24, the abrasive sleeve 27 is also forced axially up the frustro-conical member 20 which it surrounds. The radial expansion necessitated by this axial shift is permitted by the slot 31. As an alternative, the cylindrical sleeve 25 may be integral with the abrasive sleeve 27, in which case the slot 31 continues to the end of the cylindrical sleeve 25. The construction as described above permits the radius at the larger end 32 of the abrasive sleeve 27 to be adjusted to a high degree of precision. In particular, I use this means to compensate for decrease in the sleeve thickness due to wear of the abrasive material 29.

The hone is used by moving it entirely through the bore desired to be honed, with the smaller end 33 leading. The degree of taper of the hone must be quite small to hone hard metals. I find that these hones, used with my method as described below, will give a cylindrical bore true within 0.0001 inch.

The method of using my device can be seen with the aid of FIGS. 1, 2 and 3. Suppose that it is desired to obtain roller pockets 12 with a final honed cylindrical radius $r_f$ and whose axes lie a distance $R_f$ from the central axis. First roller pockets are cut into stator 10 by broaching cylindrical bores of radius r whose axes lie at a distance R from the central axis, where R is approximately equal to $R_f$ and r is approximately equal to $r_f$ and $R+r$ is less than $R_f+r_f$.

The abrasive sleeves 27 of the hones are each adjusted by the means of the nut 23 so that their outer radii at their larger ends 32 are $r_f$.

The hone-supporting member 15 is adjusted by axial movement with respect to the hones 14, so that at any point on its axis $A_c$, its radius of the hone at the corresponding point is approximately R. In particular, as will be seen in FIGS. 1 and 3, the larger end 32 of each hone contacts the hone-supporting member at a point which is a distance of $R-r_f$ from the central axis $A_c$.

The apparatus is moved axially through the rotor cavity 11, with the smaller ends of the hones leading; the direction is illustrated by arrow X in FIG. 3. FIGS. 1 and 3 depict the stator and the apparatus adjusted as described above for its first pass through the stator 10. The apparatus is shown at the same point in the course of its travel in both Figures.

After the hones have been moved completely through the cavity, the apparatus is returned to its starting position.

The hone-supporting member 15 is then adjusted axially with respect to the hones, in the direction illustrated by arrow Y of FIG. 3. The effect of this adjustment is that the hones are forced radially outward from the central axis $A_c$, and supported by the hone-supporting member 15, with their axes in new positions. Since the means supporting the proximal ends of the hone shafts permit those ends to be forced radially outward also, the shafts remain substantially parallel. As seen in FIG. 3, an axial shift of the hone-supporting member 15 of $(R_f-R)\tan\alpha$ will move the hone axes to a distance $R_f$ from the central axis. A second pass of the apparatus through the cavity will then yield the desired cylindrical bores.

It should be understood that the degree of taper of the various frustro-conical surfaces, the clearances between the hones and the sockets as broached, and the difference $R_f-R$ have been exaggerated in the Figures for illustrative purposes. In practice, a typical abrasive sleeve 27 will have a length of two to three inches or more, and the difference in the radii of its smaller and larger ends will be about 0.001 inch. An adjustment of 1 inch in the hone-supporting member then results in the hones shifting radially outward a distance of 0.0005 inches or less. Thus the notch 19 (FIG. 1), at the line where the bores 12 and 13 intersect, is insignificant.

For my purposes it has been sufficient to employ only two passes of the apparatus through the workpiece, but the honing method is generalized to other situations in which, for example, less accurate preliminary broaching is possible. It may be necessary to use many passes, and it may also be desired to enlarge the honing radii, by use of the adjustment means provided on each hone, during the sequence of passes. It will be clear to those skilled in the art that the number of passes will be largely determined by the hardness and other characteristics of the workpiece and by the volume of material which must be removed by the honing process. It will also be clear that the actual bore wall obtained by my process can never be a perfect circular cylinder. It will be a portion of an oblong cylinder. The narrow end will be a semi-circular cylinder resulting from the final cut. The bore wall adjoining each side of the semi-circular cylinder will be generally planar, with ridges corresponding to the passes or cuts of the hone. One such ridge is shown as the notch 19 (FIG. 1).

The generalized honing method of my invention can be more completely described with the aid of FIG. 6, in which $B_f$ represents a desired final bore, of radius $r_f$ and of axis $A_f$ whose distance from axis $A_c$ is $R_f$. It is necessary that the cavity 41 in the workpiece 42 contain the bores $B_c$ and $B_0$ in order that the hone and supporting member my pass through the workpiece. As seen in FIG. 6, the wall of the cavity may or may not coincide with the boundary of the bores at any point, but the cavity must "contain" the bore; that is, a cylinder with the same radius and axis must be able to be passed through the cavity. My process enlarges the cavity so that it contains, in the same sense, the desired bore $B_f$.

The method is a continuation of the two-step method described above, wherein a succession of bores are created beginning with $B_1$, centered at the axis $A_1$. The hone-supporting member has initial radius $R-r_f$ where it contacts the top of the hone. After $B_0$ is honed to the new radius $r_f$, becoming the new bore $B_1$, a second axis $A_2$, close to A, but between $A_1$ and $A_f$, is chosen. The supporting member is adjusted to support the hone at the axis $A_2$ and a new bore $B_2$ is honed. Proceeding in this manner the bores are made to approach $B_f$ as closely as desired. It should be noted that I have described a preferred method in which the axes $A_1$, $A_2$, $A_3$, etc. lie on a direct line between $A_c$ and $A_f$, but my method comprehends the use of any succession of axes so long as they approach $A_f$.

Figure 7:
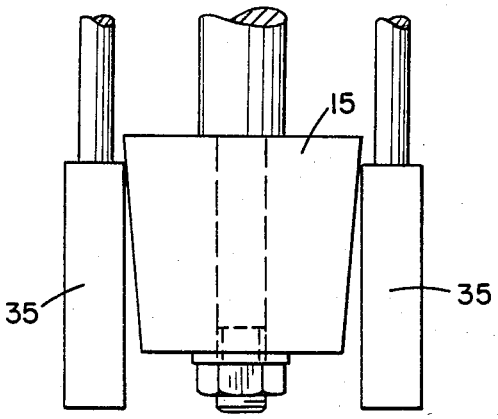
FIG. 7 is a diagrammatic elevational view of an alternate embodiment of my invention.

In an alternate embodiment of my invention, the individual hone or hones are not necessarily conical but may instead be cylindrical, or cylindrical in part. The abrasive surfaces of the hone or hones are moved radially into the pockets or bores to be honed, rather than axially through them, but each hone may be supported by an adjacent rotating member as in the preferred embodiments disclosed above, and the radial movement into the bores may be any conventional means. The shape of the hone, and of the matching surface of the supporting member, may be determined by the shape, whether cylindrical or conical, of the bore to be honed. If a cylindrical hone or hones are employed, that may be supported at only one end of the rotating frustro-conical supporting member, as seen in FIG. 7, which shows cylindrical hones 35 supported by hone-supporting member 15.

Another means of supporting cylindrical hones is by a cylindrical hone-supporting member. In this case provision will have to be made for radial adjustment by different means so that the cylindrical hones, supported by a cylinder, may be moved radially into their bores. In this embodiment, shown in FIG. 8, the radial movement is accomplished by an actual expansion of a bearing sleeve 36, by means similar to those disclosed for the expansion of abrasive sleeve 27 of the hones. The inner construction of the cylindrical hone-supporting member includes a central frustro-conical inner member 44. Bearing sleeve 36 has a complementary frustro-conical inner surface and a cylindrical outer surface. It may be caused to expand by the advancing of a nut and washer which forces the bearing sleeve axially up the inner member as in FIG. 4. I prefer, however, to move the inner member 44 instead of the bearing sleeve, and to do so by hydraulic means.

Figure 8:
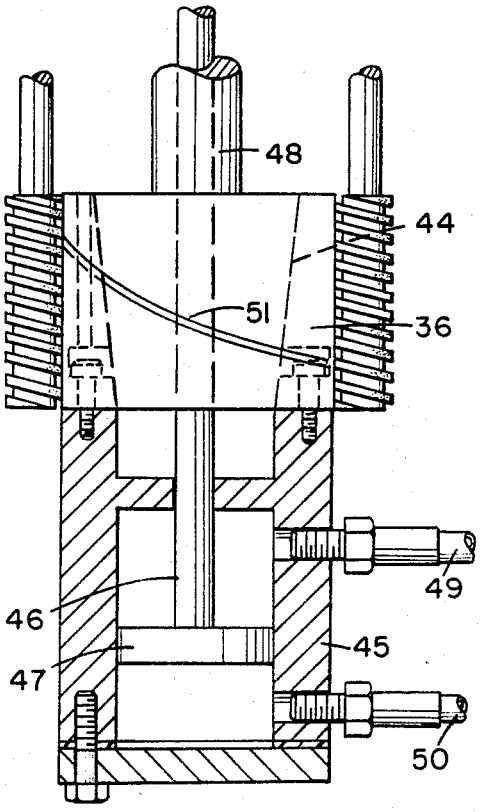
FIG. 8 is an elevational view, partly in section of yet another embodiment of my invention.

One such hydraulic arrangement is shown in FIG. 8. A hydraulic cylinder 45 is in contact with sleeve 36 and rotates with it. Hydraulic shaft 46 and piston 47 are affixed to the shaft 48 of inner member 44; these are all moved vertically by supplying air or liquid to the hydraulic chambers, either through inlet ports 49 or 50, or more conveniently, since cylinder 45 rotates, through ducting in shaft 46 and piston 47.

Figure 9:
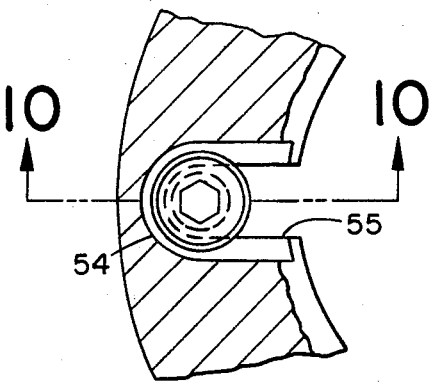
FIG. 9 is a plan view, taken as a section through lines 9—9 of FIG. 8, of a detail of the embodiment of FIG. 8.
Figure 10:
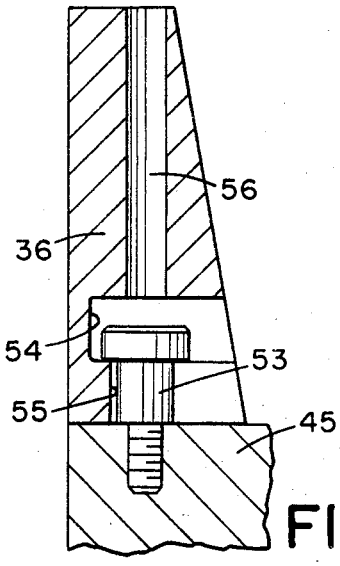
FIG. 10 is a sectional view of the detail of FIG. 9, taken through lines 10—10 of FIG. 9.

The bearing sleeve 36 has a helical slot 51, passing through and around it to permit its expansion. Means should also be provided to permit that expansion while the hydraulic cylinder 45 is joined to sleeve 36. This may be achieved by a slot arrangement such as is shown in FIGS. 9 and 10, in which a shoulder belt 53 is securely fastened to cylinder 45. Two inner walls 54 and 55 are cut into sleeve 36, sufficiently wide in the circumferential direction to accommodate bolt 53 and to provide in addition enough circumferential clearance to permit the small slide of sleeve 36, on cylinder 45, which is caused by expansion of sleeve 36. The height of inner wall 55 is less than that of the smooth part of bolt 53, which permits the bolt 53 to be tightened into cylinder 45 without hampering the slight movement of bearing sleeve 36. If desired, a shaft 56 may be provided for tightening bolt 53.

Figure 11:
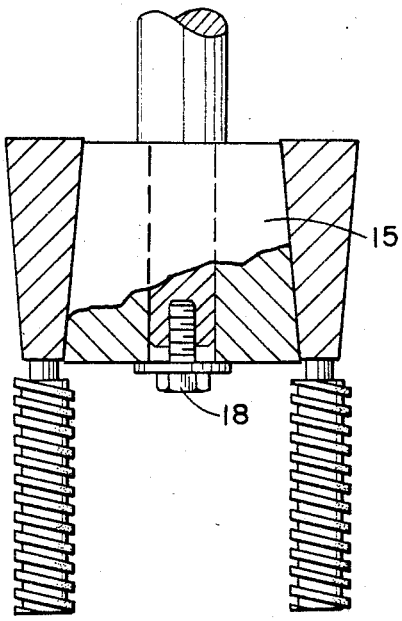
FIG. 11 is a diagrammatic elevational view of a further alternate embodiment of my invention.

Alternatively, as seen in FIG. 11, where it is again desired to employ a multiplicity of hones around a central supporting member, each hone may have a cylindrical abrasive portion 60 for machining to a cylindrical bore, and a frustro-conical section 61 elsewhere on its shaft which contacts and is supported by the matching frustro-conical central member 15 as disclosed above. In this embodiment, by a remotely controlled continuous adjustment of the nut 18, accomplished by any conventional means, the surrounding hones will undergo a continous outward radial movement into the bores. The movement of member 15 may, of course, also be done hydraulically.

Figure 12:
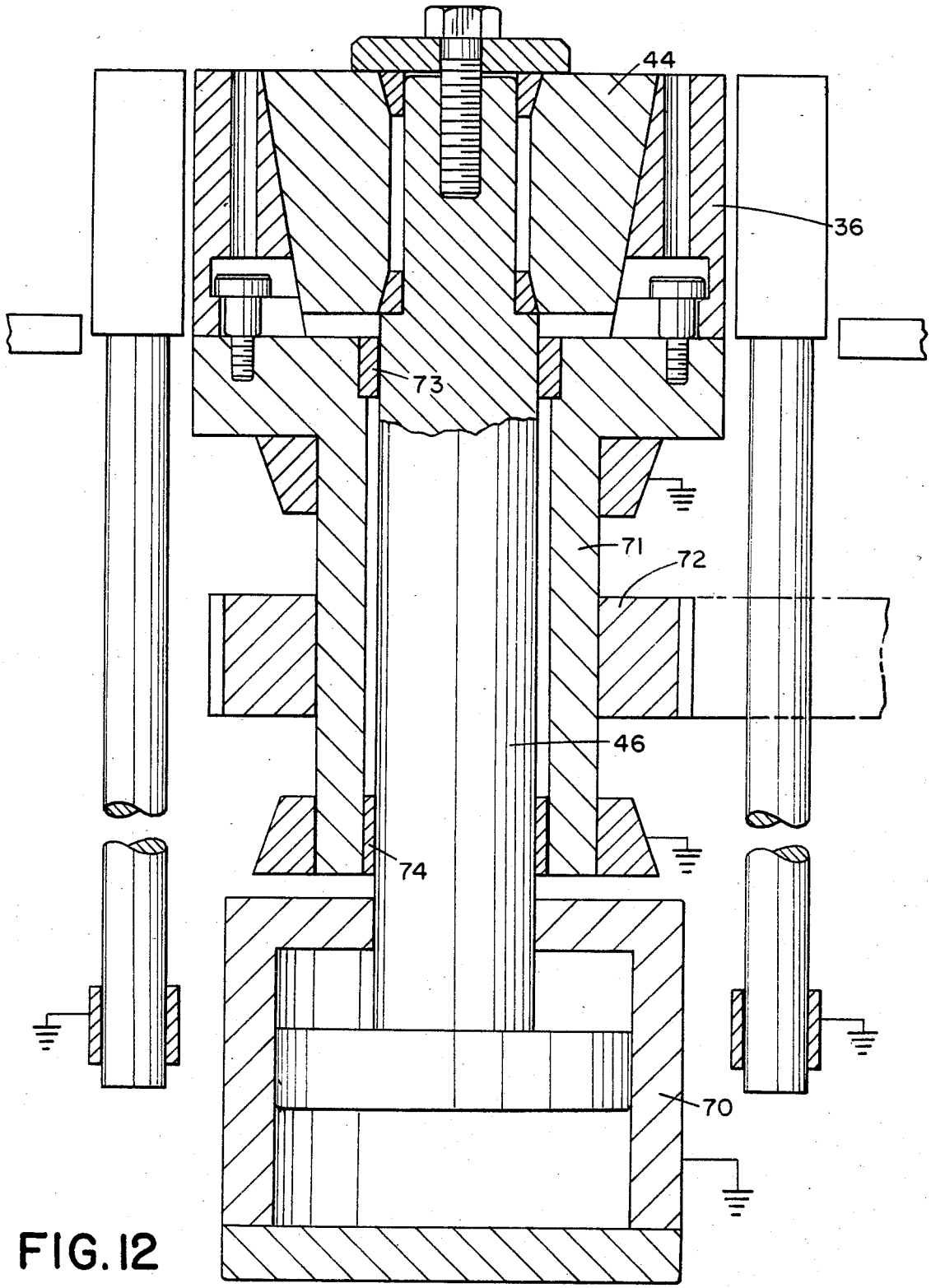
FIG. 12 is a diagrammatic elevational view of yet another alternate embodiment of my invention.

Another version of the embodiment seen in FIG. 8 is shown in FIG. 12. The hydraulically controlled shaft 46 moves the central member 44 vertically as before. But the hydraulic cylinder 70 is separated from sleeve 36 and does not rotate with it. Instead, a rotating member 71 surrounds shaft 46; it may be conveniently driven by a pulley 72. Bearings 73 and 74 are provided between rotating member 71 and shaft 46. This more compact embodiment permits the fluid to be suppled more easily into the hydraulic chambers of cylinder 70.

Although this invention has been described in its preferred form and preferred practice with a certain degree of particularity, it is understood that the present disclosure of the preferred form and preferred practice has been made only by way of example, and that numerous changes in the details of construction and the combination and arrangement of parts and steps may be resorted to without departing from the spirit and the scope of the invention as hereinafter claimed.

What is claimed is:

1. Apparatus for honing a cylindrical bore or portion thereof, comprising in combination a shaft, said shaft having an axis approximately coaxial with said bore, said shaft having a sleeve-bearing portion thereof which is generally frustro-conical and coaxial with the axis of said shaft;

an abrasive sleeve, said abrasive sleeve having inner and outer generally frustro-conical surfaces, said outer surface of said abrasive sleeve being abrasive, being coaxial with said shaft, and having a radius at its larger end approximately equal to the radius of said bore, said inner surface surrounding the sleeve-bearing portion of said shaft and closely but slidingly fitting said sleeve-bearing portion, said abrasive sleeve being provided with a longitudinal slot therethrough and extending axially the length thereof, whereby radial expansion of said abrasive sleeve is permitted;

means to move said abrasive sleeve axially on said shaft at the said sleeve bearing portion thereof, whereby axial motion in the direction of increasing radius of said sleeve bearing portion causes said abrasive sleeve to be expanded radially;

means for rotating said shaft, together with said abrasive sleeve carried thereupon, about the axis of said shaft;

means for moving said shaft and abrasive sleeve through said bore in a direction substantially parallel to its axis so that said abrasive sleeve is caused to hone said bore;

a rotatable frustro-conical hone-supporting member having on its lateral aspect an outer frustro-conically curved face, and having an axis of rotation coincident with the geometric axis of said face, said face being shaped complementarily to said abrasive sleeve such that when said hone-supporting member and said abrasive sleeve are rotated, rolling contact is made between said face and said abrasive sleeve at a point outside said bore, said hone-supporting member thus supporting said abrasive sleeve and said shaft directly against movement radially toward said axis of rotation of said hone-supporting member, and thus urging said shaft and abrasive sleeve into said bore; and means for rotating hone-supporting member.

2. Apparatus for honing a plurality of cylindrical outer bores, or portions thereof, of equal radii, disposed about the perimeter of a central bore, all of which outer bores have parallel axes, comprising in combination a plurality of hones, each associates with one of said outer bores and having an axis approximately coaxial with its said associated outer bore, each of said hones having an outer abrasive surface which is frustro-conical and coaxial with the axis of said hone, said outer abrasive surface having a radius at is larger end approximately equal to said radii of said outer bores;

means for rotating each of said outer hones;

a rotatable frustro-conical hone-supporting member having on its lateral aspect an outer frustro-conically curved face and having an axis of rotation coincident with the geometric axis of said face, said face being shaped complementarily to said hone such that when said hone-supporting member and said hones are rotated, rolling contact is made between said face and each said hone at a point outside of its said associated outer bore, said hone-supporting member thus supporting each said hone directly against movement radially toward said axis of rotation, and thus urging each of said hone into its said associated outer bore; and means for moving all of said hones through said outer bores in a direction substantially parallel to said axes of said outer bores.

3. The apparatus of claim 2, and in which said plurality of outer hones comprises a plurality of outer shafts, each associated with one of said outer bores, each said outer shaft having an axis approximately coaxial with its associated outer bore, each said outer shaft having a sleeve-bearing portion thereof which is frustro-conical and coaxial with the axis of said shaft;

a plurality of abrasive sleeves, each associated with one of said outer shafts, each said abrasive sleeve having parallel inner and outer generally frustro-conical surfaces, said outer surface of each said abrasive sleeve being abrasive and having a radius at its larger end approximately equal to said radii of said outer bores, each said inner surface surrounding the sleeve-bearing portion of said associated outer shaft and closely but slidingly fitting said sleeve-bearing portion, each said abrasive sleeve being provided with a longitudinal slot therethrough and extending axially the length thereof, whereby radial expansion of said abrasive sleeve is permiteed; and means to move each said abrasive sleeve axially on its said associated outer shaft at the said sleeve bearing portion thereof, whereby axial motion in the direction of increasing radius of said sleeve bearing portion causes said abrasive sleeve to be expanded radially.

4. The apparatus of claim 2 and further comprising means to adjust said hone-supporting member relative to said hones in an axial direction along its axis of rotation, whereby the axes of said hones may be supported by said hone-supporting member at a new position either radially away from said axis of rotation of said hone-supporting member or radially closer to said axis of rotation of said hone-supporting member.

5. In a workpiece having a cavity therein, and in which it is desired to enlarge said cavity such that a cylindrical bore $B_f$, whose axis is coincident with a line $A_f$ and whose radius is $r_f$, is contained within said cavity, and the distance between $A_f$ and another line $A_c$ is $R_f$, and said cavity further having the property that a bore $B_c$ is contained within said cavity, where the axis of $B_c$ is coincident with said line $A_c$, and $B_c$ has radius $R_f - r_f$, and $A_c$ and $A_f$ are parallel, the method of enlarging said cavity to contain the said cylindrical bore $B_f$, comprising the following steps in the order named:

(a) choosing a line $A_1$ and a radius r, said line $A_1$ being parallel to $A_c$ and $A_f$ and lying close to $A_f$, said radius r being less than but approximately equal to $r_f$, and choosing together with $A_1$ and r a frustro-conically shaped abrasive member whose greatest radius is $r_f$, such that if the said cavity is enlarged to contain a bore $B_0$ of radius r and axis $A_1$, it is possible to pass said abrasive member through said workpiece rotating about an axis coincident with $A_1$, to cut a new bore $B_1$ whose radius is $r_f$ and axis is $A_1$, and it is then possible to pass said abrasive member through said workpiece rotating about an axis coincident with $A_f$ to cut the desired final said bore $B_f$; and (b) cutting into said workpiece the said bore $B_0$ of radius r and axis $A_1$; and (c) holding said abrasive member in position by support means which pass through said bore $B_c$, which support means may be adjusted to support said abrasive member in its passage through said workpiece so that the axis of said abrasive member lies at either $A_1$ or $A_f$, and at the same time, passing through said workpiece the said abrasive member and support means with the axis of said abrasive member coincident with $A_1$, and with the abrasive member rotating around its axis; thereby cutting the bore $B_1$ into the said cavity; and (d) adjusting said support means to support said abrasive member upon said axis at $A_f$, and then (e) repeating step (c) but with the axis of said abrasive member coincident with $A_f$, thereby cutting the desired bore $B_f$.

6. In a workpiece having a cavity therein, and in which it is desired to enlarge said cavity such that a cylindrical bore $B_f$, whose axis is coincident with a line $A_f$ and whose radius is $r_f$, is contained within said cavity, and the distance between $A_f$ and another line $A_c$ is $R_f$, and said cavity further having the property that bores $B_c$ and $B_0$ both are contained within said cavity, where the axis of $B_c$ is coincident with said line $A_c$ and $B_c$ has radius $R_f - r_f$, and where the axis of $B_0$ is coincident with another line $A_1$ and $B_0$ has radius r, and $A_c$, $A_1$, and $A_f$ are parallel, and r is less than but approximately equal to $r_f$, the method of enlarging said cavity to contain the said cylindrical bore $B_f$, comprising the following steps in the order named:

(a) passing through said workpiece a frustro-conically shaped abrasive member whose greatest radius is $r_f$ and whose frustro-conical axis is coincident with $A_1$, and which abrasive member rotates around its axis, and which abrasive member is held in position by support means which pass through said bore $B_c$, and which support means may be adjusted to support said abrasive member in its passage through said workpiece at an axis coincident with any line A such that A is parallel to $A_c$, and lies farther from $A_c$ than $A_1$ but closer to $A_c$ than $A_f$;

(b) choosing a line $A_2$ parallel to $A_c$, and lying farther than $A_1$ from $A_c$, but closer than $A_1$ to $A_f$, such that $A_2$ is close enough to $A_1$ to permit the passage through the workpiece of said abrasive member when its axis coincides with $A_2$, and choosing $A_2$ to be at $A_f$ if possible;

(c) adjusting said support means to support said abrasive member upon said axis at $A_2$;

(d) passing said abrasive member through said workpiece with its axis at $A_2$;

(e) if $A_2$ was not at $A_f$, choosing a line $A_3$ lying farther than $A_2$ from $A_c$, and closer than $A_2$ to $A_f$, such that $A_3$ is close enough to $A_2$ to permit the passage through the workpiece of said abrasive member when its axis coincides with $A_3$;

(f) repeating steps (c) and (d) for said axis $A_3$; and (g) repeating said steps (e), (c) and (d) as long as necessary, in the order given, for successive choices $A_4$, $A_5$, etc., successively approaching $A_f$, until some choice of axis $A_n$ may be made to coincide with the desired final axis $A_f$.

7. As in claim 5 or 6 and in which said adjusting of said support means comprises the axial moving, with respect to said abrasive member, of an adjacent frustro-conically shaped support member.

8. Apparatus for honing a cylindrical bore or a portion thereof, comprising in combination a frustro-conical hone, adapted to hone said bore by being moved through it in a direction substantially parallel to its axis;

means for rotating said hone about a first axis coincident with the axis of said bore; and rotating frustro-conical hone-supporting member having on its lateral aspect an outer frustro-conically curved face, and having a second axis of rotation coincident with the geometric axis of said face, said face being shaped complementarily to said hone such that when said hone-supporting member and said hone are rotated, rolling contact is made between said face and said hone at a point outside said bore, said hone-supporting member thus supporting said hone directly against movement radially toward said second axis of rotation, and thus urging said hone into said bore.

9. The apparatus of claim 8, and further comprising means to adjust said hone-supporting member relative to said hone in an axial direction along said second axis, wherein said hone may be supported by said hone-supporting member at a new position either radially away from said axis or radially closer to said second axis.

10. Apparatus for honing a plurality of cylindrical bores or of portions thereof, all of which bores have parallel axes, comprising in combination a plurality of frustro-conical hones, each adapted to hone one of said bores by being moved through it in a direction substantially parallel to its axis;

means for rotating each of said hones about an axis coincident with the axis of its associated bore; and a rotatable frustro-conical hone-supporting member having on its lateral aspect an outer frustro-conically curved face, and having an axis of rotation coincident with the geometric axis of said face, and parallel to the said axes of said bores, said face being shaped complementarily to each of said hones such that when said hone-supporting member and said hones are rotated, rolling contact is made between said face and each said hone at a point outside said bore, said hone-supporting member thus supporting each said hone directly against movement radially toward said axis of rotation of said hone-supporting member, and thus urging each said hone into its said associated bore.

11. The apparatus of claim 10, and further comprising means to adjust said hone-supporting member relative to said hones in an axial direction along its said axis of rotation, whereby the axes of said hones may be supported by said hone-supporting member at a new position either radially away from said axis of rotation of said hone-supporting member or radially closer to said axis of rotation of said hone-supporting member.

12. Apparatus for honing a cylindrical bore or portion thereof, comprising in combination a shaft, said shaft having an axis approximately coaxial with said bore;

a hone carried upon said shaft, said hone having an outer generally frustro-conical surface, said outer surface of said hone being abrasive and having an axis coaxial with said shaft, and having a radius at its larger end approximately equal to the radius of said bore;

means for rotating said shaft, together with said hone carried thereupon, about the axis of said shaft;

means for moving said shaft and hone through said bore in a direction substantially parallel to its axis so that said hone is caused to hone said bore;

a rotatable frustro-conical hone-supporting member having on its lateral aspect an outer frustro-conically curved face, and having an axis of rotation coincident with the geometric axis of said face, said face being shaped complementarily to said outer surface of said hone such that when said hone-supporting member and said hone are rotated, rolling contact is made between said face and said outer surface of said hone at a point outside said bore, said hone-supporting member thus supporting said hone and said shaft directly against movement radially toward said axis of rotation of said hone-supporting member, and thus urging said shaft and hone into said bore; and means for rotating said hone-supporting member.

13. Apparatus for honing a plurality of cylindrical outer bores, or portions thereof, disposed about the perimeter of a central bore, all of which outer bores have parallel axes, comprising in combination a plurality of cylindrical hones, each associated with one of said outer bores and having an axis approximately coaxial with its said associated outer bore;

means for rotating each of said outer hones;

a rotatable cylindrical or frustro-conical hone-supporting member having on its lateral aspect an outer curved face and having an axis of rotation coincident with the geometric axis of said face, such that when said hone-supporting member and said hones are rotated, rolling contact is made between said face and each said hone at at least least one point outside of its said associated outer bore, said hone-supporting member thus supporting each said hone directly against movement radially toward said axis of rotation; and means for moving all of said hones into said outer bores in a radial direction.

14. Apparatus for honing a cylindrical bore or portion thereof, comprising in combination a shaft, said shaft having a first axis approximately coaxial with said bore;

an abrasive member carried upon said shaft, said abrasive member having an outer generally cylindrical surface, said outer surface of said abrasive member being abrasive, being coaxial with said shaft, and having a radius approximately equal to the radius of said bore;

a support-contacting member having an outer generally frustro-conical surface which is coaxial with said shaft;

means for rotating said shaft, together with said abrasive and support members carried thereupon, about said first axis of said shaft;

a hone-supporting member having an outer face which is frustro-conical and which has a second axis of rotation coincident with the geometric axis of said face, said face being shaped complementarily to said outer surface of said support-contacting member and of such radius at each point along its second axis that when said hone-supporting member and said shaft are rotated, rolling contact is made between said face and said outer surface of said support-contacting member along at least part of the axial length of each of said face and said outer surface of said support-contacting member, said hone-supporting member thus supporting said shaft directly against movement radially toward said second axis; and means for rotating said hone-supporting member about said second axis.

15. The apparatus of claim 14, and further comprising means to adjust said hone-supporting member relative to said support-contacting member in an axial direction along the said second axis of said hone-supporting member whereby said first axis of said shaft may be either urged by said hone-supporting member radially away from said second axis or permitted to move radially closer to said second axis.

* * * * *